US006126142A

United States Patent [19]

Wolf et al.

[11] Patent Number: 6,126,142

[45] Date of Patent: Oct. 3, 2000

[54] FLUID DRAIN DEVICE

[76] Inventors: Edwin J. Wolf; Edith M. Wolf, both of P.O. Box 837, Bedfield, N. Dak. 58622

[21] Appl. No.: 09/310,440

[22] Filed: May 12, 1999

[51] Int. Cl.[7] ..... F16K 31/00

[52] U.S. Cl. ..... 251/354; 251/146.9; 251/339

[58] Field of Search ..... 251/149.6, 339, 251/354

[56] References Cited

U.S. PATENT DOCUMENTS

| | | | |
|---|---|---|---|
| 1,058,736 | 4/1913 | Duey | 251/149.6 |
| 3,538,950 | 11/1970 | Porteners | 137/608 |
| 4,100,637 | 7/1978 | Grieser, Sr. et al. | 7/158 |
| 4,269,237 | 5/1981 | Berger . | |
| 4,483,359 | 11/1984 | Robertson . | |
| 4,492,249 | 1/1985 | Arino et al. . | |
| 4,709,722 | 12/1987 | Knapp . | |
| 4,768,542 | 9/1988 | Morris . | |
| 4,917,356 | 4/1990 | Shirdavani . | |
| 4,940,209 | 7/1990 | Fish . | |
| 4,976,233 | 12/1990 | Bedi et al. . | |
| 5,048,578 | 9/1991 | Dorf et al. . | |
| 5,197,515 | 3/1993 | Saville et al. . | |
| 5,373,914 | 12/1994 | Maher . | |
| 5,392,826 | 2/1995 | Saville et al. . | |
| 5,535,784 | 7/1996 | Saville et al. . | |
| 5,630,451 | 5/1997 | Bernard . | |
| 5,667,195 | 9/1997 | McCormick . | |

*Primary Examiner*—Kevin Shaver
*Assistant Examiner*—David A. Bonderer
*Attorney, Agent, or Firm*—Hardaway/Mann IP Group Nexsen Pruet Jacobs & Pollard, LLP

[57] ABSTRACT

A drain system for a liquid container such as an oil sump comprising an insert into the container, a combination tool and a safety plug. The insert contains a ball-type check valve which is opened by insertion of the combination tool, which may be held in place by rotation to engage a locking pin in the drain. The safety plug is insertable in the drain plug and tightened with a handle on the combination tool.

5 Claims, 1 Drawing Sheet

FLUID DRAIN DEVICE

BACKGROUND OF THE INVENTION

1. Field of the Invention

This invention relates to valves for the draining of sumps, especially oil sumps on internal combustion engines.

2. Background and Prior Art

Motor oil breakdown over time and through hard use is an unavoidable problem. To effect an oil change, it has been necessary to remove a plug from the bottom of the oil sump and catch the oil in some container as it pours out. The person changing the oil is confronted with a dilemma: drop the plug at the point when oil is about to flow and let the plug fall into the oil catch container or accept the fact that some oil will pour over the fingers. There is some evidence that routine skin contact with used motor oil is not healthy and should be minimized.

The location of the drain plug must be at or near the bottom of the sump. Typically, it is located where the bottom of the sump meets the sides, at about a 45 degree angle. On farm machinery and many trucks, access to the drain plug is not a difficulty. The majority of automobiles and light trucks must be elevated to drain the oil.

On many vehicles, the drain plug is located at or near the lowest part of the vehicle and the almost universal use of a short bolt or plug reflects the need to limit exposure beneath the vehicle.

Numerous attempts have been made to resolve the problems which attend oil changes. U.S. Pat. No. 4,269,237 to Berger disclosed a check valve opened when a tube was inserted into a fitting screwed into the oil pan. The tube was attached by a bayonet fitting which extended away from the pan. A foam rubber sleeve was described which seems needed to minimize leakages.

U.S. Pat. No. 4,709,722 to Knapp describes a valve apparatus having a spring loaded check valve which is opened when a vacuum is drawn on the fitting. A external pump is required to open the valve.

U.S. Pat. No. 4,917,356 to Shirdavani discloses a poppet valve in a fitting screwed into the sump and which is activated by pulling a cable.

U.S. Pat. No. 4,940,209 to Fish discloses a ball type check valve inserted into an oil sump and activated by a lever affixed to a pipe which is screwed into the check valve fitting.

U.S. Pat. No. 5,048,578 to Dorf et al. is directed to a check valve and bayonet fitting for use with a pump to drain oil.

U.S. Pat. No. 5,630,451 to Bernard describes an insert for an oil sump which incorporates a plug valve.

U.S. Pat. No. 5,667,195 to McCormick discloses an oil drain valve similar in concept to a Schraeder valve.

None of the references described is simple and leak-proof. The number of patents indicates a long-felt need for a device of this type. The lack of such a device on the market indicates that the need has not been met.

BRIEF SUMMARY OF THE INVENTION

It is an object of this invention to provide a leak proof drain plug for a container of liquids or sump. It is a further object of this invention to provide a leak proof drain plug which does not need to be removed from the container or sump and which may be used many times.

It is another object of this invention to provide a drain tube for connecting the leak proof drain plug to a tube or container. It is another object of this invention to provide a drain tube which also serves as a valve actuating mechanism. It is still another object of this invention to provide a drain tube which also serves as a wrench.

It is a further object of this invention to provide a leak proof drain plug which does not project farther from the container than a conventional dead ended plug.

These and other objects of the invention are accomplished be a drain plug consisting of three components: a plug in the form of a tubular bolt having an axial bore, a multi-sided head, threads about the circumference of the bolt, an internal check valve in the form of a ball, seat and spring secured by a snap ring, a diagonal pin and a sealing O-ring; a dead ended plug threadably insertable into the axial bore of the tubular bolt and having a polygonal recess in its head; and a hollow drain tube having at one end a pair of notches engageable with the lock pin in the tubular bolt and having on the external side of the tube a polygonal handle insertable into the head of the dead ended plug.

DETAILED DESCRIPTION OF THE INVENTION

Figure 1:
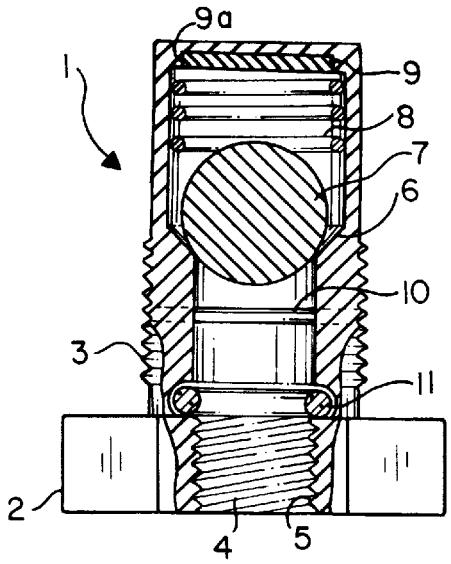
FIG. 1 is a drawing in partial relief of the drain plug insert according to this invention.
Figure 3:
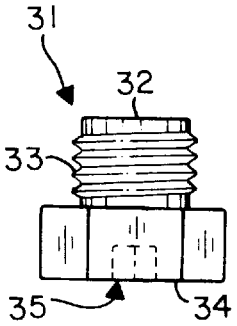
FIG. 3 shows one embodiment of a plug safety seal bolt according to this invention.
Figure 2:
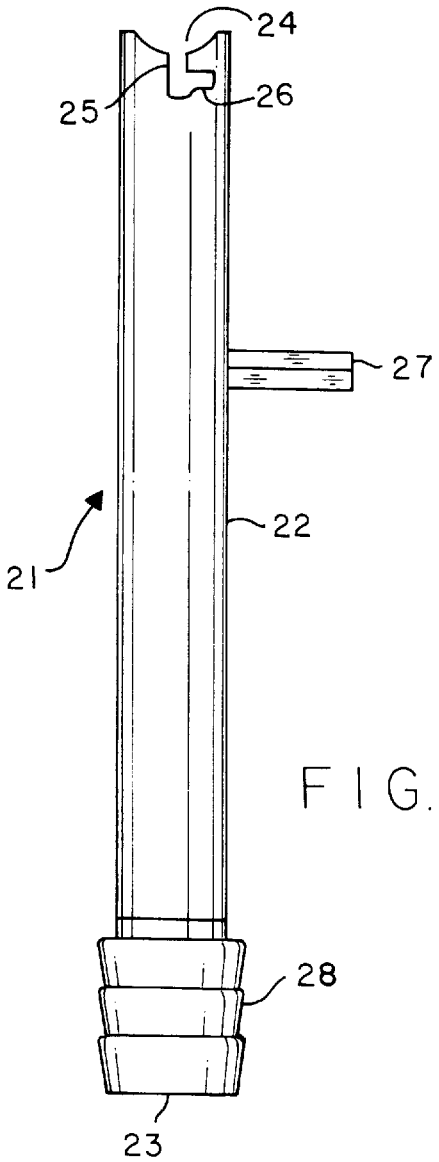
FIG. 2 shows the combination handle, wrench and drain tube according to this invention

The drain plug of this invention, as shown in FIG. 1, has a bolt shaped external appearance 1 consisting of a polygonal head 2, and circumferential threads 3 about the cylindrical plug shape. A through bore 4 is formed axially in the plug. In the region of head 2, threads 5 are tapped internally. The diameter of through bore 4 is increased slightly to form a seat 6 which receives a ball 7 which is urged toward seat 6 by spring 8. Spring 8 is held in position by snap ring or circlip 9 held in place by a groove or sill 9*a* at or near the end of the plug 1.

A pin 10, hereinafter locking pin 10, is inserted across the through bore 4 between head 2 and seat 6. The locking pin 10 may define a diameter of through bore 4 or may be slightly offset. If the locking pin is inserted in the area of external threads 3, no particular structure is required to hold it in place. In the preferred embodiment, through bore 4 is machined circumferentially between head 2 and locking pin 10 to receive a gasket in the form of a rubber O-ring 11, the purpose of which will be discussed below.

The combination handle, wrench and drain tube 21 is formed from a tubular member or pipe 22 having a hollow bore 23. At one end 24, the tube is relieved axially to form two groves 25 to receive locking pin 10. Preferably, the relief is extended circumferentially to form lands 26 into which locking pin 10 can be arrested by rotation of the tube. The depth of grooves 25 must be such that when the locking pin is within the grooves, the tube will be extended into drain plug 1 far enough to force ball 7 from seat 6. When the tube is rotated, the locking pins will hold the tube in place within the drain plug while retaining ball 7 away from seat 6.

Projecting perpendicularly from the side of the tube is a handle which has, in cross-section, a polygonal shape. In the preferred embodiment, the shape is hexagonal and with the handle is a type of hex key or Allen wrench. The chosen shape is not critical except that the handle must be usable in combination with safety seal bolt 31. A square end equivalent to a ¼ in. ratchet drive, a "star" drive, a Phillips head or even a straight blade fall within the scope of this invention.

At the end of tube 22, the surface 28 may be adapted to receive a flexible hose or tubing which may be used to direct the drained fluid to a receptacle.

Safety seal bolt 31 is a closed end bolt or plug having a dead end 32, threads 33 and a head 34. In the preferred embodiment, a polygonal recess is formed into the head region, the recess being shaped to receive the end of handle 27.

Not shown in the drawings are gaskets which should be used to seal the bolt heads and the surfaces to which they land.

In use, the drain plug 1 is inserted in place of the conventional drain plug and the open end is secured with safety seal bolt 31, which serves as a redundant seal and also excludes road dirt from the valve mechanism. When the fluid is to be replaced, the bolt 31 may be removed using handle 27. The combination tool 21, to which a tube may be attached at adapter end 28, is inserted into through bore 4 until the tool is stopped by pin 10. The tool is then turned to lock in groove 26 and left in place until the fluid has drained out. The O-ring 11 prevents leakage around drain tube 22 while the oil is draining. The process is repeated in reverse, the fluid is replaced, and the job is complete.

While this invention has been described in terms of preferred embodiments, it is apparent to those skilled in the art that numerous variations and modifications may be made without departure from the inventive concept.

We claim:

1. A kit for gravity withdrawal of a fluid from a container comprising a drain plug, a combination tool and a safety seal bolt wherein said drain plug comprises a through bolt having a polygonal head, external threads, a through bore having internal threads, and a spring-loaded ball landing on a seat, said ball being biased toward closure by said spring, a circling retaining said spring in said drain plug and a pin crossing said through bore between said ball and said head.

2. A kit according to claim 1, wherein said drain plug further comprises an O-ring seal seated in said through bore between said pin and said head.

3. A kit according to claim 1, wherein said combination tool comprises a tubular member having a first end relieved axially on opposite sides, a handle in the cross-sectional shape of a polygon, and an end opposite said first end adapted to hold flexible tubing.

4. A kit according to claim 3, wherein said combination tool further comprises a radially relieved portion lateral to said axial reliefs, and, optionally, a notch formed therein.

5. A kit according to claim 1, wherein said safety seal bolt comprises a dead-ended bolt having external threads matchable, a head and a polygonal recess in said head adapted to receive a tool.

* * * * *